US007822374B2

(12) United States Patent
Hazeyama et al.

(10) Patent No.: US 7,822,374 B2
(45) Date of Patent: Oct. 26, 2010

(54) IMAGE FORMATION DEVICE

(75) Inventors: Tomoaki Hazeyama, Mie (JP); Kenjiro Nishiwaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 6 days.

(21) Appl. No.: 12/407,160

(22) Filed: Mar. 19, 2009

(65) Prior Publication Data

US 2009/0238612 A1 Sep. 24, 2009

(30) Foreign Application Priority Data

Mar. 21, 2008 (JP) ..... 2008-073361

(51) Int. Cl.
*G03G 15/16* (2006.01)

(52) U.S. Cl. ..... 399/296

(58) Field of Classification Search ..... 399/128, 399/149, 283, 284, 296
See application file for complete search history.

(56) References Cited

U.S. PATENT DOCUMENTS 5,960,240 A * 9/1999 Ida et al. ..... 399/296
6,246,847 B1 * 6/2001 Jeong et al. ..... 399/101
2007/0242985 A1 10/2007 Aoki et al.

FOREIGN PATENT DOCUMENTS

| | | | |
|---|---|---|---|
| JP | 55-089884 | A | 7/1980 |
| JP | 2002268498 | | 9/2002 |
| JP | 2003345106 | A | 12/2003 |
| JP | 2006058547 | | 3/2006 |
| JP | 2007310355 | | 11/2007 |

OTHER PUBLICATIONS

JP Office Action dtd Nov. 10, 2009, JP Appln. 2008-073361, English translation.

* cited by examiner

*Primary Examiner*—Hoang Ngo
(74) *Attorney, Agent, or Firm*—Banner & Witcoff, Ltd.

(57) ABSTRACT

There is provided an image formation device comprising an electrostatic latent image holding body having an latent image formation surface on which an electrostatic latent image is formed, a developer supply unit to supply developer to the electrostatic latent image holding body to form, on the latent image formation surface, a developer image corresponding to the electrostatic latent image; a developer transfer unit located to face the electrostatic latent image holding body to transfer the developer image to a developer image holding surface; and a contacting member to contact the latent image formation surface at a stage which is after formation of the developer image and before transfer of the developer image to the developer image holding surface.

8 Claims, 2 Drawing Sheets

IMAGE FORMATION DEVICE

CROSS-REFERENCE TO RELATED APPLICATION

This application claims priority under 35 U.S.C. §119 from Japanese Patent Application No. 2008-073361, filed on Mar. 21, 2008. The entire subject matter of the application is incorporated herein by reference.

BACKGROUND

1. Technical Field

Aspects of the present invention relate to an Image Formation Device.

2. Related Art

Regarding design of image formation devices, various types of attempts to improve imaging quality have been made.

For example, Japanese Patent Provisional Publication No. 2006-58547A discloses a configuration where an image correction member to which a voltage having an alternate voltage component is applied is provided on the downstream side of an imaging region to suppress "thinning" of an edge part of an electrostatic latent image.

In a configuration disclosed in Japanese Patent Provisional Publication No. 2002-268498A, a surface of a photosensitive drum is exposed uniformly before a transfer process (i.e., so-called "pre-transfer exposure") to improve the transfer process. In this configuration, timing of the pre-transfer exposure is controlled to prevent toner from scattering during the pre-transfer exposure.

SUMMARY

Aspects of the present invention are advantageous in that an image formation device capable of forming a high quality image with a simple structure is provided.

According to an aspect of the invention, there is provided an image formation device, comprising: an electrostatic latent image holding body having an latent image formation surface on which an electrostatic latent image is formed, the latent image formation surface being provided to be parallel with a main scanning direction and to move in a direction perpendicular to the main scanning direction; a developer supply unit configured to supply developer to the electrostatic latent image holding body to form, on the latent image formation surface, a developer image corresponding to the electrostatic latent image; a developer transfer unit located to face the electrostatic latent image holding body while sandwiching a developer image holding body between the developer transfer unit and the electrostatic latent image holding body, the developer transfer unit being configured to transfer the developer image formed on the latent image formation surface to a developer image holding surface of the developer image holding body; and a contacting member configured to contact the latent image formation surface at a stage which is after formation of the developer image on the latent image formation surface and before transfer of the developer image to the developer image holding surface by the developer transfer unit.

Since the contacting member contacts the latent image formation surface after the development and before the transferring (i.e., the developer distributed on the latent image formation surface in accordance with the developer image is pressed by the contacting member), the imaging quality can be enhanced. For example, by pressing the developer after the development and before the transferring, occurrence of the above described "thinning" of an edge part of the latent image can be prevented. Scattering of the developer during a pre-transfer exposure can also be prevented suitably. In particular, deterioration of an image during a multi-color image formation process can be suitably prevented. Therefore, the image formation device is able to form a high quality image with a simple structure.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
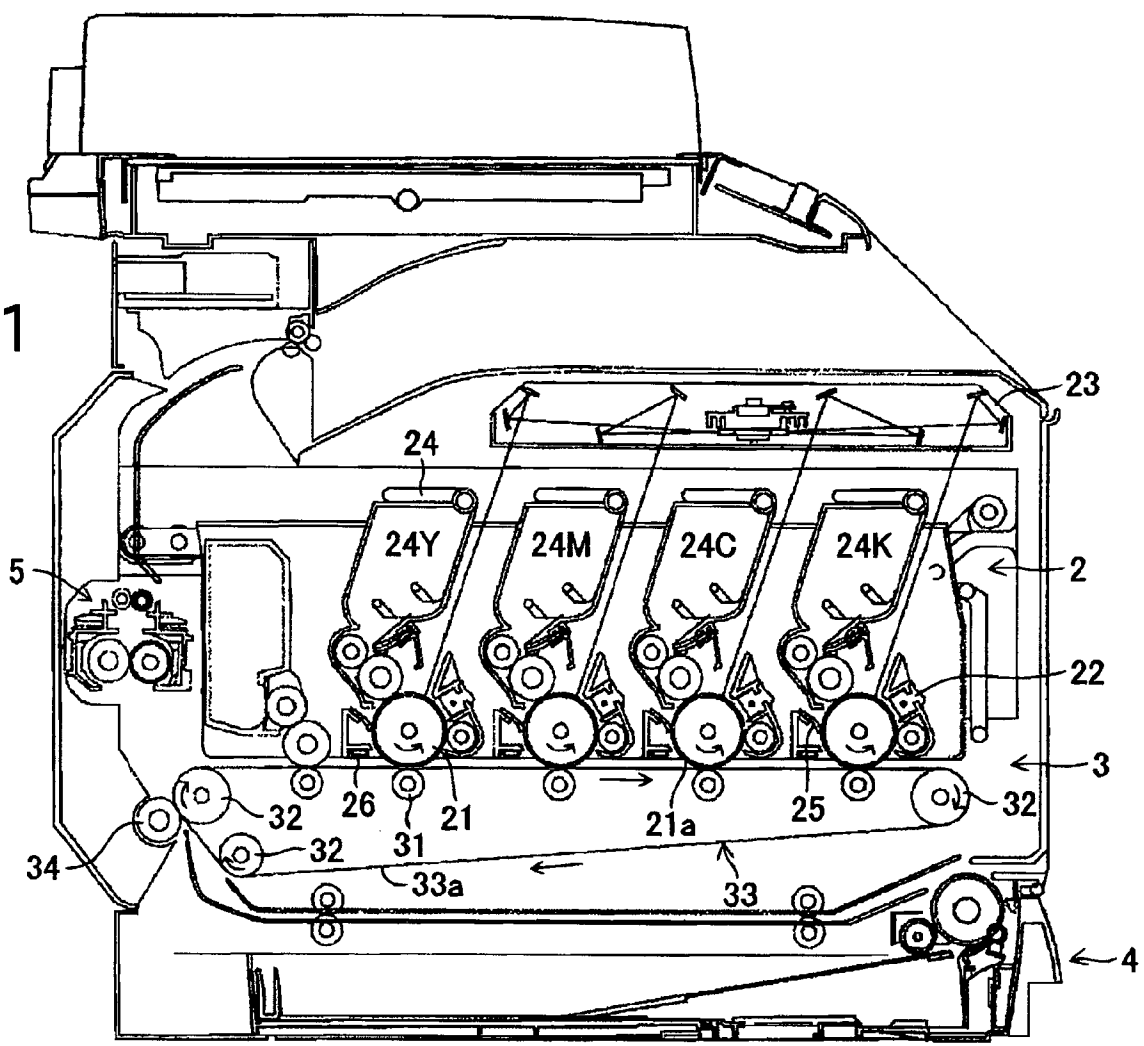
FIG. 1 illustrates a side cross section of a laser printer according to an embodiment.

FIG. 1 is a side cross section of a laser printer 1 according to an embodiment. In the following, a right side on FIG. 1 is defined as a "front side", and a left side on FIG. 1 is defined as a "back side", a left-and-right direction on FIG. 1 is defined as "back-and-forth direction", and a direction perpendicular to the surface of FIG. 1 is defined as a "main scanning direction".

As described below, the laser printer 1 uses microscopic powdery dry type toner (hereafter, simply referred to as toner) to form an image on a sheet of paper. The laser printer 1 is capable of forming a multi-color image (a so-called a full-color image) by using four colors of toner including yellow, magenta, cyan and black toner. As shown in FIG. 1, the laser printer 1 includes a developing unit 2, a transfer unit 3, a paper supply unit 4 and a fixing unit 5.

Hereafter, the developing unit 2 is explained in detail. As shown in FIG. 1, in the laser printer 1, four photosensitive drums 21 are arranged along the back-and-forth direction to be parallel with each other. Each photosensitive drum 21 functions as an electrostatic latent image holding body. The photosensitive drum 21 is a cylindrical member having a center axis extending in parallel with the main scanning direction, and a peripheral surface thereof is formed as a latent image formation surface 21*a*. The latent image formation surface 21*a* is a surface which is parallel with the main scanning direction and on which an electrostatic latent image is formed with potential distribution. By rotating each photosensitive drum 21 in a rotational direction indicated by an arrow in FIG. 1, the latent image formation surface 21*a* moves in a direction perpendicular to the main scanning direction.

Four chargers 22 are arranged along the back-and-forth direction to face the photosensitive drums 21, respectively. The charger 22 is located, in the rotational direction of the photosensitive drum 21, on the downstream side with respect to a position where the photosensitive drum 21 faces the transfer unit 3. The charger 21 serves to uniformly charge the latent image formation surface 21*a*.

On the upper side of the photosensitive drum 21, a scanning unit 23 is located. For each of the photosensitive drums 21, the scanning unit 23 emits a laser beam modulated based on image information to scan on the latent image formation surface 21*a* charged uniformly by the charger 22 in the main scanning direction.

On the downstream side with respect to a position where the photosensitive drum 21 is scanned by the laser beam, four toner supply device 24 are located to face the photosensitive drums 21, respectively. More specifically, a toner supply device 24Y accommodating yellow toner, a toner supply device 24M accommodating magenta toner, a toner supply device 24C accommodating cyan toner and a toner supply device 24B accommodating black toner are arranged in this order from the back side to the front side.

The toner supply device 24 supplies toner to the latent image formation surface 21*a* on which an electrostatic latent image has been formed so that toner is distributed on the latent image formation surface 21*a* in accordance with the image pattern of the electrostatic latent image.

On the downstream side in the rotational direction of the photosensitive drum 21 with respect to a position where the toner supply device 24 faces the photosensitive drum 21, a contacting member 25 is provided to contact the latent image formation surface 21*a*. That is, for four photosensitive drums 21, four contacting members 25 are arranged along the back-and-forth direction.

In this embodiment, the contacting member 25 is formed of a plate-like member having a semiconducting property (e.g., a synthetic resin sheet containing carbon), and is configured to be supplied with a predetermined bias voltage. The predetermined bias voltage is lower than a voltage of a non-image part on the latent image formation surface 21*a* where no toner is placed and is higher that a voltage of an image part on the latent image formation surface 21*a* where toner is placed.

The contacting member 25 has a proximal end and a distal end, and the distal end is formed as a free end. The contacting member 25 is positioned such that the projecting direction from the proximal end toward the distal end is oriented to be along the moving direction of the latent image formation surface 21*a*, so as to prevent the toner image on the latent image formation surface 21*a* from being disarranged. The contacting member 25 is located such that the distal end elastically presses the latent image formation surface 21*a*.

As described above, the contacting member 25 is provided to contact the latent image formation surface 21*a* after the toner is held on the latent image formation surface 21*a* and before the toner image is transferred to the side of the transfer unit 3. Further, the contacting member 25 is arranged to be able to contact the latent image formation surface 21*a* before the toner is held on the latent image formation surface 21*a*.

As shown in FIG. 1, for each of the photosensitive drums 21, a pre-transfer exposure unit 26 is provided to face the latent image formation surface 21*a* between the position where the contacting member 25 faces the photosensitive drum 21 and the position where the transfer unit 3 faces the photosensitive drum 21. That is, four pre-transfer exposure units 26 are arranged along the back-and-forth direction to face the photosensitive drums 21, respectively. The pre-transfer exposure unit 26 exposes uniformly the latent image formation surface 21*a* which has passed the contacting member 25 after the latent image has been developed with the toner through the toner supply device 24.

Hereafter, the transfer unit 3 is explained in detail. As shown in FIG. 1, four belt transfer rollers 31 are provided with respect to the photosensitive drums 21, respectively. More specifically, the belt transfer rollers 31 are arranged along the back-and-forth direction to be parallel with each other. In addition to the belt transfer rollers 31, a plurality of belt support rollers 32 are provided. An intermediate transfer belt 33 formed as an endless belt is hung on outer surfaces of these rollers 31 and 32. The intermediate transfer belt 33 functions as a developer image holding body.

A transfer bias voltage is applied to the belt transfer rollers 31. The transfer bias voltage serves to transfer the toner held on the latent image formation surface 21*a* to a toner image holding surface 33*a* which is the outer surface of the intermediate transfer belt 33. The toner image holding surface 33*a* functions as a developer image holding surface.

The intermediate transfer belt 33 is moved in a direction indicated by an arrow in FIG. 1 by rotating at least one of the belt support rollers 32 through a driving mechanism (e.g., a motor) not shown in FIG. 1. That is, the intermediate transfer belt 33 is moved along the moving direction of the latent image formation surface 21*a* by rotation of the photosensitive drum 21 through a gap between the photosensitive drum 21 and the belt transfer roller 31 in a state where the toner image holding surface 33*a* faces the photosensitive drum 21.

A paper transfer roller 34 is provided to face the toner image holding surface 33*a* which has passed the four photosensitive drums 21. The paper transfer roller 34 is provided at the position facing the belt support roller 32. To the paper transfer roller 34, a paper transfer bias voltage for transferring the toner on the toner image holding surface 33*a* to the sheet of paper is applied.

Hereafter, an image formation operation executed on the laser printer 1 is described. The latent image formation surfaces 21*a* of the four photosensitive drums 21 are respectively irradiated with the laser beams modulated in accordance with the image information. As a result, electrostatic latent images are formed on the latent image formation surfaces 21*a*, respectively.

More specifically, on the latent image formation surface 21*a* of the photosensitive drum 21 facing the toner supply device 24Y, yellow toner supplied by the toner supply device 24Y is held on the latent image formation surface 21*a* while being distributed in accordance with the electrostatic latent image. That is, the latent image formation surface 21*a* on the photosensitive drum 21 corresponding to the toner supply device 24Y is developed with yellow toner. Similarly, the latent image formation surface 21*a* of the photosensitive drum 21 corresponding to the toner supply device 24M is developed with magenta toner, the latent image formation surface 21*a* of the photosensitive drum 21 corresponding to the toner supply device 24C is developed with cyan toner, and the latent image formation surface 21*a* of the photosensitive drum 21 corresponding to the toner supply device 24B is developed with black toner.

By rotation of each photosensitive drum 21 in the rotational direction indicated by the arrow shown in FIG. 1, each latent image formation surface 21*a* developed with the toner having the corresponding color moves toward the position facing the intermediate transfer belt 33. After contacting the contacting member 25, each latent image formation surface 21*a* is exposed uniformly by the pre-transfer exposure unit 26. Then, each latent image formation surface 21*a* moves to the position where the latent image formation surface 21*a* faces the belt transfer roller 31 while sandwiching the intermediate transfer belt 33 between the latent image formation surface 21*a* and the belt transfer roller 31. That is, the latent image formation surface 21*a* moves to the position facing the toner image holding surface 33*a*.

At the position where the photosensitive drum 21 corresponding to the toner supply device 24Y faces the intermediate transfer belt 33, the yellow toner image held on the latent image formation surface 21*a* is transferred to the toner image holding surface 33*a* of the intermediate transfer belt 33. The toner image holding surface 33*a* on which the yellow toner image has been transferred moves from the back side toward to the front side until the toner image holding surface 33*a* reaches the position facing the photosensitive drum 21 corresponding to the toner supply device 24M. At this position, the magenta toner image held on the latent image formation surface 21*a* is transferred to the toner image holding surface 33*a*.

Similarly, the cyan toner image held on the latent image formation surface 21*a* of the photosensitive drum 21 corresponding to the toner supply device 24C is transferred to the toner image holding surface 33*a* to which the yellow toner image and the magenta toner image have been transferred. Finally, the black toner image held on the latent image formation surface 21*a* of the photosensitive drum 21 corresponding to the toner supply device 24K is transferred to the toner image holding surface 33*a* to which the yellow toner image, the magenta toner image and the cyan toner image have been transferred.

The toner image holding surface 33*a* holding the image formed with the four color toner moves to the position facing the paper transfer roller 34. At this position, the image formed with the four color toner is transferred to the sheet of paper. The four color image transferred to the sheet of paper is fixed on the sheet of paper by the fixing unit 5.

As described above, according to the embodiment, the latent image formation surface 21*a* and the contacting member 25 contact with each other at the stage after the development and before the transferring. That is, at the time after the development and before the transferring, the toner distributed on the latent image formation surface 21*a* in accordance with the image is pressed by the contacting member 25. As a result, the "thinning" of an edge part of the toner image can be suitably prevented. More specifically, toner in an edge part of a toner image formed on the latent image formation surface 21*a* of the photosensitive drum 21 tends to slightly move toward the central portion of the toner image due to the effect of the electric field of the outside of the toner image. In this case, the toner existing slightly inward with respect to the edge part of the toner image is risen by the effect of the electric field of the outside of the toner image. As a result, the height of the toner existing slightly inward with respect to the edge part of the toner image becomes higher than the height of the toner image at the central portion. Therefore, by pressing the toner image with the contacting member 25, it becomes possible to flatten the toner image (i.e., toner on the toner image) on the photosensitive drum 21, and to move the toner toward the edge part. Consequently, it becomes possible to prevent occurrence of the "thinning".

Incidentally, regarding a configuration in which a plurality of image formation units (corresponding to the plurality of photosensitive drums 21 and the toner supply devices 24) are arranged (i.e., a so-called tandem arrangement), it is preferable that the pre-transfer exposure is performed by the pre-transfer exposure unit to prevent the image from being disarranged by the electrostatic discharge between the photosensitive drum and the intermediate transfer belt. However, since in this case the binding force for binding the toner on the photosensitive drum decreases considerably, the toner image might be deteriorated due to such decrease of the binding force at the stage before the transferring.

By contrast, according to the embodiment, the toner distributed in accordance with the image on the latent image formation surface 21*a* is pressed by the contacting member 25 at the stage after the development and before the pre-exposure and the transferring. Consequently, it becomes possible to suitably prevent the image from being disarranged even if the pre-transfer exposure is performed. In particular, the "thinning" of an edge part of the image caused when a multi-color image is formed in the "tandem" arrangement and "scattering" of toner due to the pre-exposure can be suitably prevented.

In this embodiment, the contacting member 25 is positioned such that the contacting member 25 contacts the latent image formation surface 21*a* and slides on the latent image formation surface 21*a* even if a toner layer is not formed on the latent image formation surface 21*a*. In other words, there is no necessity to precisely control the gap between the contacting member 25 and the latent image formation surface 21*a*. Therefore, according to the embodiment, it is possible to enhance the imaging quality with a simple structure.

By applying the predetermined bias voltage to the contacting member 25, t is possible to effectively prevent the deterioration of the toner image on the latent image formation surface 21*a* and adhesion of toner to the contacting member 25.

More specifically, by applying, to the contacting member 25, the bias voltage higher than the image portion on the latent image formation surface 21*a* on which the toner is placed, the electrostatic forth toward the image portion acts on the toner. As a result, the toner existing between the contacting member 25 and the latent image formation surface 21*a* is prevented from adhering to the contacting member 25. Therefore, decrease of the density in the toner image can be prevented effectively.

Since the bias voltage lower than the non-image part of the latent image formation surface 21*a* on which the toner is not placed is applied to the contacting member 25, the electrostatic force toward the contacting member 25 acts on the toner in the non-image part. As a result, the toner existing between the contacting member 25 and the latent image formation surface 21*a* (i.e., the non-image portion) is prevented from adhering to the non-image part. The contacting member 25 is also able to collect the toner accidentally adhered to the non-image part. Therefore, occurrence of white fogging can be prevented effectively.

It should be noted that the toner adhered to the contacting member 25 can be collected through the latent image formation surface 21*a*, for example, during a non-image formation time period. Even if the toner adhered to the contacting member 25 is collected to the image portion when the toner adhered to the contacting member 25 faces the image portion, the amount of toner collected toward the image portion is extremely small. Therefore, occurrence of a defective condition where the density of the image portion becomes excessively high does not occur.

Although the present invention has been described in considerable detail with reference to certain preferred embodiments thereof, other embodiments are possible. It should be noted that parts of feature of variations described below may be combined.

In the above described embodiment, the technical feature is applied to the applied to the laser printer. However, the technical feature described in the embodiment may be applied to various types of electrophotographic image formation devices, such as a monochrome laser printer, or a monochrome or color facsimile device. The shape of the photosensitive unit is not limited to the drum shape shown in the above described embodiment. For example, a plate type or an endless belt type photosensitive unit may be employed.

In the above described embodiment, the intermediate transfer belt 33 serves as the developer image holding body. However, a configuration in which the toner is directly transferred to the sheet of paper from the photosensitive drum 21 without intervention by the intermediate transfer belt 33 may be employed. In this case, the surface of the sheet of paper corresponds to the developer image holding surface.

Figure 2:
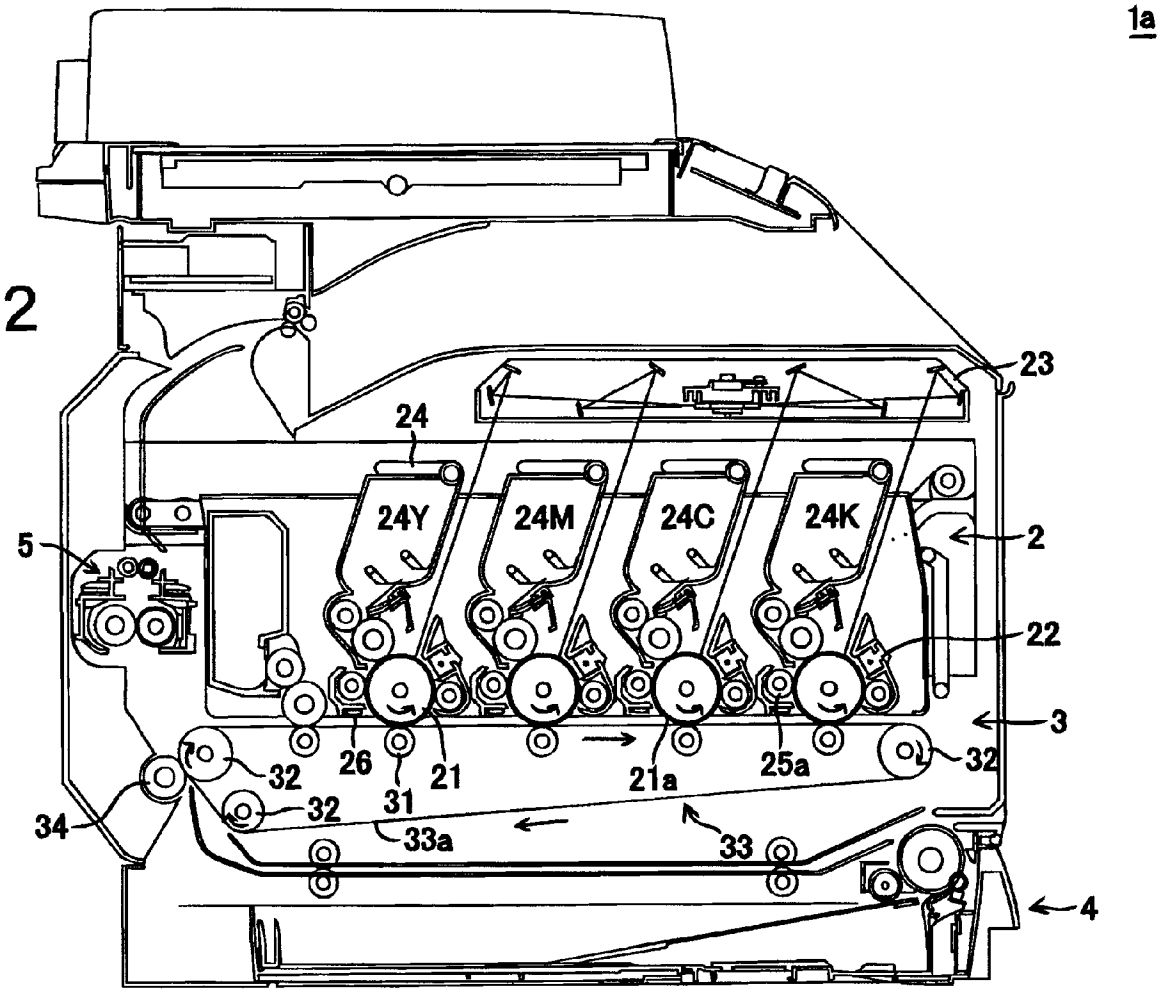
FIG. 2 is a cross section illustrating a variation of the laser printer shown in FIG. 1.

FIG. 2 is a side cross section of a laser printer 1*a* employing roller-type contacting members 25*a* in place of the contacting members 25 of the above described embodiment. As shown in FIG. 2, each contacting member 25*a* has an axis line extending in parallel with the main scanning direction. Each roller type contacting member 25*a* is arranged to be rotatable about the axis line as the center axis.

The roller-type contacting member 25*a* is made of material having conductivity and elasticity (e.g., synthetic rubber containing carbon). It is preferable that the roller-type contacting member 25*a* is positioned to face-contact with the latent image formation surface 21*a* by a predetermined nip width (e.g., the width of 1 to several millimeters).

What is claimed is:

1. An image formation device, comprising:

an electrostatic latent image holding body having an latent image formation surface on which an electrostatic latent image is formed, the latent image formation surface being provided to be parallel with a main scanning direction and to move in a direction perpendicular to the main scanning direction;

a developer supply unit configured to supply developer to the electrostatic latent image holding body to form, on the latent image formation surface, a developer image corresponding to the electrostatic latent image;

a developer transfer unit located to face the electrostatic latent image holding body while sandwiching a developer image holding body between the developer transfer unit and the electrostatic latent image holding body, the developer transfer unit being configured to transfer the developer image formed on the latent image formation surface to a developer image holding surface of the developer image holding body; and a contacting member configured to contact the latent image formation surface at a stage which is after formation of the developer image on the latent image formation surface and before transfer of the developer image to the developer image holding surface by the developer transfer unit.

2. The image formation device according to claim 1, further comprising a pre-transfer exposure unit configured to expose uniformly the latent image formation surface at a position between the contacting member and the developer transfer unit.

3. The image formation device according to claim 2, wherein:

the developer image holding body is configured to have a form of an endless belt such that the developer image holding surface facing the latent image formation surface moves along a moving direction of the latent image formation surface;

a plurality of electrostatic latent image holding bodies each of which corresponds to the electrostatic latent image holding body are provided respectively for a plurality of types of developer to be arranged along the moving direction of the latent image formation surface;

a plurality of developer supply units each of which corresponds to the developer supply unit are provided respectively for a plurality of types of developer to be arranged along the moving direction of the latent image formation surface;

a plurality of developer transfer units each of which corresponds to the developer transfer unit are provided respectively for a plurality of types of developer to be arranged along the moving direction of the latent image formation surface;

a plurality of contacting members each of which corresponds to the contacting member are provided respectively for a plurality of types of developer to be arranged along the moving direction of the latent image formation surface; and a plurality of pre-transfer exposure units each of which corresponds to the pre-transfer exposure unit are provided respectively for a plurality of types of developer to be arranged along the moving direction of the latent image formation surface.

4. The image formation device according to claim 1, wherein the contacting member includes a roller type member having an axis parallel with the main scanning direction, the roller type member being rotatable about the axis.

5. The image formation device according to claim 1, wherein the contacting member includes a plate-like member provided to elastically press the latent image formation surface.

6. The image formation device according to claim 5, wherein the plate-like member is provided such that a projecting direction thereof is oriented to be along a moving direction of the latent image formation surface.

7. The image formation device according to claim 1, wherein the contacting member is formed of material having a semiconducting property.

8. The image formation device according to claim 7, wherein a predetermined bias voltage is applied to the contacting member.

* * * * *